US006287029B1

(12) United States Patent
Goda et al.

(10) Patent No.: US 6,287,029 B1
(45) Date of Patent: Sep. 11, 2001

(54) MULTI-LAYER INK RIBBON AND MANUFACTURE THEREOF

(75) Inventors: Hitoshi Goda; Masakazu Takahashi, both of Osaka; Yoshiro Kitamura, Kanazawa, all of (JP)

(73) Assignees: Fujicopian Co., Ltd., Osaka; Kitamura Mfg. Co., Ltd., Matto, both of (JP)

( * ) Notice: Subject to any disclaimer, the term of this patent is extended or adjusted under 35 U.S.C. 154(b) by 0 days.

(21) Appl. No.: 09/572,782

(22) Filed: May 17, 2000

(30) Foreign Application Priority Data

May 19, 1999 (JP) ..... 11-138323

(51) Int. Cl.[7] ..... B41J 31/02
(52) U.S. Cl. ..... 400/237; 400/241; 400/241.3
(58) Field of Search ..... 400/237, 241, 400/241.3, 241.4

(56) References Cited

U.S. PATENT DOCUMENTS 5,478,160 * 12/1995 Radcliffe ..... 400/241.1
5,984,547 11/1999 Kitamura et al. .

FOREIGN PATENT DOCUMENTS 60-19578 1/1985 (JP) .
01-26349 5/1989 (JP) .
1-26349 5/1989 (JP) .
11-078186 3/1999 (JP) .
11-291593 10/1999 (JP) .

* cited by examiner

*Primary Examiner*—John S. Hilten
*Assistant Examiner*—Kevin D. Williams
(74) *Attorney, Agent, or Firm*—Armstrong, Westerman, Hattori, McLeland & Naughton, LLP

(57) ABSTRACT

The object of the invention is to provide a multi-layer ink ribbon having a long printing life and a substantial freedom from causing unevenness of prints and a process for manufacturing the above ink ribbon. In accordance with the invention, a plurality of webs each constructed by using multifilament yarns for both warp and weft are superposed and fuse-cut to the width of a ribbon. At least one of the webs is compressed by hot pressing in advance and assembled with at least one web either not hot-pressed or hot-pressed to a degree of compression different from the first-mentioned hot-pressed web. The resulting assembly is fuse-cut under pressure to the width of a ribbon and the ribbon thus obtained is inked.

4 Claims, 1 Drawing Sheet

(a)

(b)

MULTI-LAYER INK RIBBON AND MANUFACTURE THEREOF

FIELD OF THE INVENTION

The present invention relates to a multi-layer ink ribbon for impact printing which features a long printing life and a substantial freedom from print defects and to a method of manufacturing the same. In the present specification, the term "ink ribbon" is used to indicate "a ribbon for printing", irrespective of whether it has been inked or not yet inked.

BACKGROUND OF THE INVENTION

Ink-saturated endless ribbons are widely used as unicolor or multicolor ink ribbons for the wire dot printers of computers, word processors or like devices. Such endless ribbons are manufactured by producing a plain-woven fabric using a nylon or polyester multi-filament yarn as warp and as weft, slitting said plain-woven fabric to a predetermined width in such a manner that the direction of warp coincides with the longitudinal direction of the ribbon, and joining both ends of the ribbon with each other to make it endless.

There also is known the so-called seamless ribbon which is manufactured by producing a tubular, jointless (namely seamless) plain-woven fabric by double or tubular weaving and then fuse-cutting the same in the radial direction. In this case, contrary to the above-mentioned case of obtaining endless ribbons from a plain-woven fabric, the direction of weft of the fabric becomes the longitudinal direction (circumferential direction) of the ribbon. Seamless ribbons are advantageous just because, unlike endless ribbons, they have no junction.

In manufacturing such seamless ribbons, nylon or polyester multifilament yarn is generally used as warp and weft.

When a 40d/34f multifilament yarn, for instance, is used for weaving, the mean yarn density is typically selected as shown below in Table 1. The most representative is a quasi-high density construction with a warp density of about 146 yarns/inch, a weft density of about 148 yarns/inch and a total density of about 294 yarns/inch.

TABLE 1

| | Warp density A (yarns/inch) | Weft density B (yarns/inch) | A + B (yarns/inch) |
|---|---|---|---|
| Ordinary density product | 132 | 142 | 274 |
| Quasi-high density product | 146 | 149 | 294 |
| High density product | 190 | 150 | 330 |
| Very high density product | 180 | 162 | 342 |

As regards the ribbon width, unicolor ribbons are relatively narrowand, as the number of colors increases, the width is increased accordingly. The circumferential length of the ribbon may be selected arbitrarily, although the upper limit to the ink ribbon circumferential length is by itself defined when the ribbon is intended to be loaded into a standardized cassette. Though dependent on cassette size, the ribbon is loaded in two different ways: a ribbon with a long circumferential length (e.g. 2600~3000 mm) is folded in a zig-zag fashion and encased in that condition, while a ribbon with a short circumferential length (e.g. 200 mm or 300 mm) is not fold but simply mounted on the roll of a compact cassette.

When the ink ribbon contained in a cassette and making a round arrives at the head, it is struck by the printer needle and the ink in the remaining part of the ribbon diffuses to resume homogeneity.

In impact printing, a platen, a printing paper, a perforated mask, an ink ribbon and a head are arranged in that order, a dot printer needle protruding from the head is thrust against the ink ribbon to thereby strike the ink ribbon, through holes of the mask, against the paper, with the resulting shock being absorbed by the platen.

As the ink ribbon, a ribbon manufactured by laminating a woven fabric with a polymer film or another woven fabric and fusion-cutting the laminate to the width of a ribbon are known. For example, JP Kokai S60-19578 describes a ribbon for typewriter or other use which has been fabricated by integrating both lateral edges of two ribbons superposed one on the other.

Japanese Patent Publication H-01-26349 (JP Kokai S57-93187) discloses a method of manufacturing ink ribbon base cloths which comprises reducing, by 2 to 10%, the thickness, after scouring and setting, of a high density woven fabric composed of 20 to 120 denier synthetic fiber multifilament yarns as warp and weft and having a warp density of 150 to 220 yarns/inch and a weft density of 100 to 140 yarns/inch by pressing under heating, without rendering the same film-like, to render the same apparently reed mark-free. The thickness reduction is effected by hot pressing using a heating and pressing means, at least two rollers of which are driven at different speeds in a ratio of 1:1.1 to 1:2.0.

JP Kokai H11-43840, the Japanese Patent application filed by the present applicant on which U.S. Pat. No. 5,984,547 is based, discloses a seamless ink ribbon comprising a seamless woven fabric constructed by using multifilament yarns for both warp and weft and reduced in thickness by 15~50% from the original thickness by static hot pressing without shearing force application.

JP Kokai H11-78186, recently laid open, discloses an ink ribbon comprising a base or substrate ribbon made of two superposed webs having dissimilar characteristics, with the web of greater abrasion resistance being disposed on the printing paper side and the web of greater impact transmissivity being disposed on the printer head side. To implement this base ribbon construction, the following arrangements are mentioned.

- The thickness of the substrate web on the printing paper side is designed to be larger and that of the web on the printer head side smaller.
- The fiber weight or density per unit area of the substrate web on the paper side is designed to be higher and that of the substrate web on the printer head side lower.
- The rate of crimp of the yarn for the substrate web on the printing paper side is designed to be lower by 2~5% as compared with the web on the printer head side.

Paragraphs [0024], [0036], [0048] and [0078] and FIG. 4 of the above-mentioned official gazette JP Kokai H11-78186 describe and illustrate the manner in which a ribbon made of two woven substrate webs superposed one on the other is pressed into a flat substrate by means of heat and pressure. In the description of the prior art in Paragraph [0057] et seq. of the same gazette, there is a description of the conventional single-layer ink ribbon.

In the case of an ink ribbon with a short circumferential length which is loaded in a compact cassette, the frequency of the ribbon being subjected to the impact of the printer needle is considerably high because of its short circumferential length, with the result that the ribbon is damaged early and must be exchanged at short intervals. Thus, although the ink ribbon still holds a sufficient amount of ink, it must be discarded as the number of characters which can be printed with one ink ribbon (the number of sheets of paper which can be printed) is considerably decreased.

The above shortcomings can be overcome to some extent by using an ink ribbon made of a fabric/polymer film laminate or a fabric/fabric laminate, fuse-cutting it to the width of a ribbon and splicing the resulting strip but such a measure is far from providing a fundamental solution to the problem.

The invention disclosed in Japanese Patent Publication H1-26349 referred to above relates to an endless ribbon constructed by splicing both ends of a ribbon and is intended to liquidate the reed mark of a high-density woven fabric. In addition, this invention is concerned with a single-layer ribbon which has been reduced in thickness by 2~10% from the original thickness by means of two rollers varied in peripheral speed and it is stated that if the reduction in thickness exceeds 10%, the profile of the ribbon is flattened to approach to that of a film and the ink absorbability is adversely affected.

JP Kokai H11-43840 referred to above, a patent application field by the present inventors, describes only a single-layer seamless ink ribbon. Here, subsequent investigations made by the present inventors revealed that there is a limit to increasing the printing life even if the thickness is reduced by static hot pressing, thus leaving room for further improvement.

Furthermore, in JP kokai H11-291593, which had not been disclosed yet as of the filing date of the Japanese application of this invention, the present applicant disclosed a multi-layer ink ribbon manufactured by hot-pressing a substrate laminate consisting of two webs each woven using multifilament yarns for both weft and warp, said substrate laminate having been compressed and set by 25~65% thinner than the sum of thicknesses of the respective webs prior to hot pressing and the laminate has been fuse-cut to the ribbon width. However, it has been discovered that when two webs are hot-pressed in superimposition as it is the case with this multi-layer ink ribbon, the fiber of the substrate fabric is partially fused and deformed by the heat and pressure to cause non-uniformity of the interfilament voids necessary for holding the ink with the inevitable local variation in the amount of ink saturation, so that uneven prints tend to take place in the course of printing.

JP Kokai H11-78186 referred to above describes a mode in which a ribbon made of superposed webs is flattened by the application of heat and pressure (Examples 1 and 2; FIG. 4) and a mode in which the conventional single-layer ribbon is flattened by heat and pressure (prior art) but the technology disclosed has disadvantages similar to those of the technology described in JP Kokai H11-43840 (U.S. Pat. No. 5,984,547) and the technology described in JP Kokai H11-291593 (not disclosed yet as of the filing date of this application) both filed by the present applicant.

OBJECT OF THE INVENTION

Developed in the above state of the art, the present invention has for its object to provide a multi-layer ink ribbon having a long printing life and free from the unevenness of prints and a process for manufacturing the same.

SUMMARY OF THE INVENTION

The multi-layer ink ribbon of the present invention is an ink ribbon comprising a plurality of woven webs each constructed by using multifilament yarns for both warp and weft as superposed and fuse-cut to the width of a ribbon, characterized in that at least one of said woven webs has been compressed by hot pressing while at least one of said webs has been either not hot-pressed or hot-pressed to a degree of compression different from that of said compressed web.

The process for manufacturing a multi-layer ink ribbon according to the present invention comprises superposing a plurality of woven webs each constructed by using multifilament yarns for both warp and weft and fuse-cutting the resulting assembly, characterized in that at least one of said webs is reduced in thickness by hot pressing in advance and then assembled with at least one of said webs which has been not hot-pressed or hot-pressed to a degree of compression different from that of said compressed web, the resulting assembly is fuse-cut under pressure to the width of a ribbon, and the resulting ribbon is inked to provide an ink ribbon.

DETAILED DESCRIPTION OF THE PREFERRED EMBODIMENTS

Figure 1:
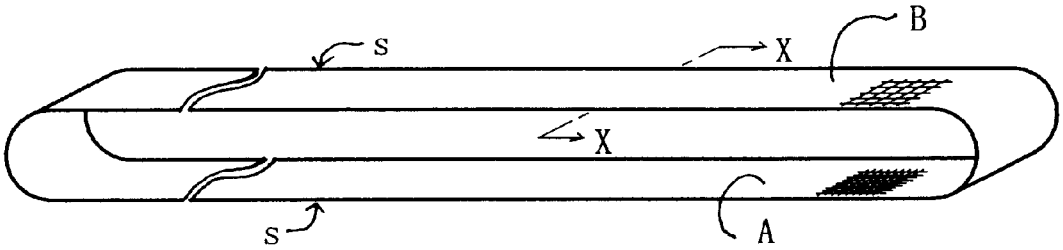
FIG. 1 is a schematic diagram showing a multi-layer ink ribbon embodying the principles of the invention, wherein (a) is a perspective view and (b) is an end view in section taken along the line X—X of (a)
Figure 1:
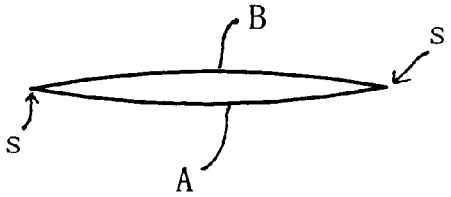

The present invention is now described in detail.

In the multi-layer ink ribbon according to the present invention, multifilament yarns are used for the warp and weft constituting the base or substrate fabric (web). Nylon (e.g. nylon 66 or nylon 6) is a preferred material, although a polyester may also be used.

The warp and weft yarns which can be used include those in conventional use, typically 40d/34f, 30d/26f and 30d/12f, and others varying in weight and filament number. As is well known in the art, d (denier) is the number of grams of the yarn per 9,000 m and f is the number of filaments per multifilament yarn.

As regards the mean yarn density to be used in weaving, a quasi-high density is desirable when 40d/34 f multifilament yarn, for instance, is used. In that case, the warp density is about 146 yarns/inch, the weft density is about 148 yarns/inch, and the total density is about 294 yarns/inch. It is, however, possible to select various warp and weft densities; not only quasi-high density but also ordinary density, high density, very high density, etc.

The substrate fabric can be provided in the form of an ordinary flat woven fabric constructed by the ordinary weaving method or in the form of a cylindrical radially seamless fabric constructed by the conventional circular or tubular weaving method. The circular weaving method is a method of weaving a fabric made up of two webs joined at both ends in the repeated reciprocation of the weft yarn.

As to the construction of the fabric, a plain-weave construction is suited for an ink ribbon but any other suitable construction may also be utilized.

After weaving, the fabric may be optionally after-treated, e.g. scoured and heat-set.

The multi-layer ink ribbon of the present invention is so constructed that a plurality (2 is practical but 3 may also be useful) of woven webs each constructed by using multifilament yarns for both warp and web are superposed one on the other and then fuse-cut to the width of a ribbon. Fuse-cutting results in the structure in which the web of each layer is jointed to the web of another layer only at both edges of the ribbon.

In order to provide a multi-layer ribbon in the form of a loop, taking an ordinary flat fabric as an example, it is usual that fabrics are jointed at ends to form a loop in the first place, the component webs are then superposed one on the other so that the webs may constitute an inner layer and an outer layer, respectively, and the resulting assembly is fuse-cut. In the case of seamless fabrics, the fabrics are set one on the other and, then, fuse-cut.

Of the webs to be laminated, at least one has been compressed by hot pressing and at least one web has been either not hot-pressed or hot-pressed to a degree of compression different from that of said compressed web.

When two webs are to be assembled into a ribbon, either the following construction (a) or the following construction (b) is employed. The construction (a) is advantageous costwise, while the construction (b) is advantageous in that the total thickness can be reduced.

(a) Of the two webs A and B to be assembled, the web A has been compressed by hot pressing and the web B has not been hot-pressed.

(b) of the two webs A and A' to be assembled, both webs A and A' have been hot-pressed but to dissimilar degrees of compression.

In the case (a) above, the degree of compression a of the web A after hot pressing is preferably 15~50% (more preferably 20~40% and particularly 25~35%) of the thickness prior to hot pressing. If the degree of compression by hot pressing is insufficient, no marked improvement in the printing life of the ribbon can be expected and, because of the large thickness of the two-layer ribbon, the print quality will be adversely affected. On the other hand, if the degree of compression by hot pressing is too high, the fabric itself tends to be impaired or the penetration of the ink may be adversely affected. The "thickness" as referred to herein is the mean of thicknesses measured at a multiplicity of points in a circumferential direction of the ribbon with a thickness gauge or equivalent.

In the case of (b) above, for the same reason as mentioned for the case of (a), the degree of compression a of the web A after hot pressing is preferably 15~50% (particularly 20~40%) as compared with the thickness prior to hot pressing and the degree of compression a' of the web A' is preferably 1~45% (particularly 5~35%) as compared with the thickness prior to hot pressing, with a differential of a−a'= at least 5% (particularly at least 10%).

When three webs are assembled, possible combinations include high compression/no compression/no compression, high compression/low compression/no compression, high compression/low compression/low compression, high compression/high compression/no compression, high compression/high compression/low compression, low compression/low compression/no compression, and low compression/no compression/no compression. However, the three-web construction is more complicated than the two-web construction and the total thickness tends to be large. Therefore, the two-web laminate is generally preferred.

To make the thickness of the multi-layer ink ribbon of the present invention closer to the thickness of the conventional single-layer ribbon, the weight and weaving density of yarns constituting the respective webs can be judiciously adjusted.

The hot pressing mentioned above is preferably conducted at a temperature of about 120~180° C. (particularly about 140~160° C.) under a pressure of about 100~250 kg/cm$^2$ (particularly about 180~250 kg/cm$^2$).

The hot pressing is preferably effected under no shear by static pressing. Such static hot-pressing without application of a shearing force can be carried out typically by means of a platen-type hot press.

The webs to be hot-pressed may be independently hot-pressed or a plurality of webs may be hot-pressed in an assembled state in one operation. A mat may be interposed between the fabric and each of the upper and lower platens and when a plurality of webs are to be hot-pressed in a superposed state, a mat may be additionally interposed between the respective webs. In the case of a cylindrical seamless fabric (web), a mat may be disposed internally of the fabric.

The hot pressing of a cylindrical seamless fabric can be carried out by the following methods, for instance.

In the first place, the fabric is set on the lower platen of a press and hot-pressed with heat being applied to at least one of the upper and lower platens (preferably both platens). The pressure is then released, the fabric is turned upside down, and the hot pressing is carried out in the same manner. In this case, the selvages of the weave are preferably positioned closer to the center, not at the edge.

In the first place, the fabric is set on the lower platen of a press and hot-pressed with heat being applied to at least one of the upper and lower platens (preferably both platens). The fabric thus subjected to the first hot pressing is shifted so that its end will come close to the center and the hot pressing is performed again. This procedure is followed once or repeated a few times.

The fabric is set to wrap the lower platen around and hot-pressed. Then, the laminate is shifted in a radial direction and hot-pressed again. This procedure is followed once or repeated a few times to effect hot-pressing over the entire circumference of the woven fabric. In this case, the lower platen need not be heated but may be heated to an appropriate temperature.

In each of the methods of hot pressing mentioned above, it is preferred, from the viewpoint of rapidity and uniformity of heating, that the top plate or the top and bottom platens of the press be heated by means of steam or by resistance heating. The pressing is mostly effected hydraulically.

Under certain circumstances, the hot pressing can be carried out by passing the fabric over a set of rollers. In this case, the two rollers are preferably identical in peripheral speed. However, this roller hot pressing cannot be easily applied to a seamless fabric having a short circumferential length (particularly less than about 500 mm). Therefore, the static hot-pressing with a platen-type press is by far advantageous under such conditions.

The circumferential length of the ribbon in the form of a loop depends on the space available for the ink ribbon within the cassette. Generally, cassettes meeting a standardized specification are used and, therefore, the circumferential length of the ribbon is selected within the maximum limit of loading into the available space. Even when ribbons identical in yarn density with the conventional ones are used, they are reduced in thickness by hot pressing in accordance with the present invention and, therefore, ribbons with a longer circumferential length can be loaded into a cassette.

The overlapped webs are fuse-cut to the width of a ribbon under pressure. In the course of this procedure, the edges of the upper and lower webs are fused together.

The ribbon cut to the product width is then inked to provide a finished ink ribbon. Inking is preferably carried out from the side which comes closer to the printing paper. Of course, the ink applied diffuses so that it is ultimately distributed throughout the entire thickness of the ribbon.

The color of the ink can be chosen arbitrarily. In the case of multicolor ink ribbons, two colors, i.e. black and red, or a total of four colors, black, cyan, magenta and yellow, are employed in most cases. In producing multicolor ink ribbons, a borderline or borderlines for prevention of color mixing are formed in advance in the lengthwise direction and the borderline-defined regions or lanes are saturated with the respective color inks.

The multi-layer ink ribbon of the present invention is useful as the ink ribbon for the printer of a computer, word processor or the like machine.

EXAMPLES

The following examples further illustrate the present invention without defining its scope.

Production of an Ink Ribbon

Example 1

FIG. 1 is a schematic diagram showing a multi-layer ink ribbon embodying the principles of the present invention, where (a) is a perspective view and (b) is an end view in section taken on the line X—X of (a). In FIG. 1, s represents each fused edge of the ribbon.

Using a 40d/34 f nylon 66 multifilament yarn for warp and a 30d/26f nylon 66 multifilament yarn for weft, a cylindrical seamless fabric with a circumferential length of 300 mm was woven in the plain-weave construction by circular weaving. The pick (yarn density) was 146 yarns/inch for warp and 148 yarns/inch for weft; thus, the total density was 294 yarns/inch (quasi-high density fabric). This woven fabric was scoured, then cut to the length (200 mm) of a setting drum, sleeved over the drum, and subjected to wet-heat setting.

The resulting seamless woven fabric B was mounted on a mat with tight fitting. Three webs of the thus-mounted woven fabric B were respectively interposed between 4 blank mats (the total number of mats 7, total number of webs 3) were set in superimposition on the lower platen of a hydraulic press. Both the upper and lower platens were then heated by resistance heating and the assembly was pressed at 140° C. and a static pressure of 240~250 kg/cm$^2$ for 1 minute. The press was relieved, the position of the webs was shifted, and the hot pressing was repeated. This operation was performed for a total of 4 times, whereby a compressed fabric A which has been reduced in thickness from the initial thickness of 0.090 mm to 0.060 mm was obtained. The degree of compression was 100×(0.090−0.060)/0.090=33%.

Then, this compressed seamless fabric A (thickness: 0.060 mm) was set on a cutting drum in such a manner that it comes internally of the uncompressed seamless fabric B (thickness 0.090 mm) and the assembly was fuse-cut to a width of 4 mm with a hot cutter means to prepare multi-layer ribbons. The multi-layer ribbon (total thickness 0.150 mm) was mounted on a mat and checked visually for abnormalities, after which inking was performed from the outer side. The inking rate (impregnation amount of the ink) was set to 20% of the substrate (the uninked multi-layer ribbon) weight.

Example 2

Figure 2:
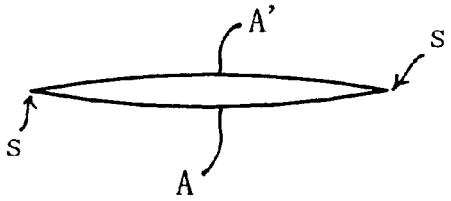
FIG. 2 is an end view in section of another multi-layer ink ribbon embodying the principles of the invention.

FIG. 2 is an end view in section of another multi-layer ink ribbon according to the invention.

Except that somewhat mild hot-pressing conditions were used, the procedure of Example 1 was otherwise repeated to provide a compressed fabric A' reduced in thickness from 0.090 mm to 0.070 mm. The degree of compression was a'=100×(0.090−0.070)/0.090=22%. This compressed fabric A' was set externally of the fabric A on a cutting drum and fuse-cut to a width of 4 mm with a hot cutter means to provide multi-layer ribbons. This multi-layer ribbon (total thickness 0.130 mm) was mounted on a mat, checked visually for abnormalities, and inked from the outer side. The inking rate (impregnation amount of the ink) was set to 20% of the substrate (the uninked multi-layer ink) weight.

Comparative Example 1

The uncompressed fabric B obtained in Example 1 (thickness 0.090 mm, degree of compression 0%) was not hot-pressed but directly fuse-cut to a width of 4 mm to give single-layer ribbons which were then inked. The inking rate (impregnation amount of the ink) was set to 24% of the substrate (uninked single-layer ribbon) weight.

Comparative Example 2

The compressed fabric A (thickness 0.060 mm, degree of compression 33%) obtained in Example 1 was fuse-cut to a width of 4 mm to give single-layer ribbons, which were then inked. The inking rate (impregnation amount of the ink) was set to 28% of the substrate (uninked single-layer ribbon) weight.

Comparative Example 3

The compressed fabric A' (thickness 0.070 mm, degree of compression 22%) obtained in Example 2 was fuse-cut to a width of 4 mm to give single-layer ribbons, which were then inked. The inking rate (impregnation amount of the ink) was set to 28% of the substrate (uninked single-layer ribbon) weight.

Reference Example 1

Two sheets of the uncompressed fabric B (thickness 0.090 mm) were superposed one on the other and hot-pressed to give a two-layer laminate A, which was then fuse-cut to a width of 4 mm. The resulting multi-layer ribbon A/A (total thickness 0.120 mm, degree of compression 33%) was inked from the outer-layer side. The inking rate (impregnation amount of the ink) was set to 20% of the substrate (uninked multi-layer ribbon) weight.

Ink Ribbon Performance Test

The ink ribbons obtained in Examples 1 and 2, Comparative Examples 1~3, and Reference Example 1 were respectively loaded into compact cassettes and using a 9-pin POS miniature printer, ultra-high printing on Chinese paper stock was carried out on a draft mode to evaluate the ink ribbon performance. The conditions used and results are shown in Table 2. For each fabric, a 40d/34 f nylon 66 multifilament yarn was used for the warp and a 30d/26f nylon 66 multifilament yarn for the weft; the yarn density was 146/148/inch or a total density of 294/inch; the width of the ribbon was 4 mm and the circumferential length of the ribbon was 300 mm. The maximum printability in Table 2 indicates the number of characters which could be printed. The unevenness of prints was rated on the scale of none ○, little □, somewhat Δ, conspicuous ×.

TABLE 2

| | Example 1 | Example 2 | Compar. Ex. 1 | Compar. Ex. 2 | Compar. Ex. 3 | Reference Ex. 1 |
|---|---|---|---|---|---|---|
| Ribbon structure | A/B | A/A' | B | A | A' | A/A |
| Ribbon thickness | 0.150 mm | 0.130 mm | 0.090 mm | 0.060 mm | 0.070 mm | 0.120 mm |
| Degree of compression | 33%/0% | 33%/22% | 0% | 33% | 22% | 33%/33% |
| Maximum printability | $400 \times 10^4$ | $410 \times 10^4$ | $80 \times 10^4$ | $100 \times 10^4$ | $90 \times 10^4$ | $450 \times 10^4$ |
| Unevenness of prints | ○ | □ | ○ | Δ~x | □ | Δ~x |

It is clear from Table 2 that Example 1 is characterized by a large number of characters that could be printed without causing the unevenness of prints and Example 2 also features a large number of characters that could be printed with little unevenness of prints. In contrast, Comparative Example 1, which is a single-layer ribbon not hot-pressed, showed a considerably small number of characters that could be printed. In Comparative Examples 2 and 3, which are ribbons hot-pressed but single-layer in structure, the number of characters that could be printed was fewer and the unevenness of prints was remarkable. The multi-layer ribbon obtained in Reference Example 1, where two webs were superposed and hot-pressed, was satisfactory in respect of the number of characters that could be printed but not free from the unevenness of prints.

EFFECTS OF THE INVENTION

In the multi-layer ink ribbon according to the present invention, at least one of the woven webs to be laminated has been compressed by hot pressing while at least one of the webs has been either not hot-pressed or hot-pressed to a degree different from said compressed web. Taking a two-layer structure as an example for assisting in the understanding of the ribbon of the invention, the structure may be indicated as A/B or A/A' where A represents a high-compressed web, A' represents a low-compressed web and B represents an uncompressed eweb.

The high-compressed web A of the two-layer ribbon has been hot-pressed but is not different in the weaving density from the uncompressed web so that the strength is not decreased despite the reduced thickness. In addition, the high-compressed web A has a rather increased strength because its filaments have been somewhat fused by hot pressing. Therefore, the impact of the printer head from behind is cushioned by this high-compressed web A to mitigate the damage to the uncompressed web B or low-compressed web A' which lies closer to the printing paper, thus contributing to the printing life of the ribbon.

Furthermore, the uncompressed web B or low-compressed web A' which lies closer to the paper is least subject to the fusion or deformation of filaments so that the interfilament spaces available for holding the ink are not diminished. Therefore, the ribbon is uniformly saturated with the ink without any difference from the ribbon not hot-pressed.

The high-compressed web A has been reduced in thickness and the low-compressed web A' has also been somewhat reduced in thickness, so that the gain in thickness of the whole multi-layer ribbon is within an allowable range.

What is claimed is:

1. A multi-layer ink ribbon comprising a woven substrate consisting of a plurality of webs each constructed by using multifilament yarns for both warp and weft and fuse-cut to laminate the webs together to a width of a ribbon, at least one of said webs having been compressed by hot pressing to a thickness of about 15–50% of a thickness prior to pressing, and at least another one of said webs having been either not hot-pressed or hot pressed to a degree of compression different from that of said at least one of said webs that have been compressed.

2. The multi-layer ink ribbon according to claim 1, wherein the woven substrate consists of two webs A and B, the web A having been compressed by hot pressing and the web B having been not compressed by hot pressing.

3. The multi-layer ink ribbon according to claim 1 wherein the woven substrate consists of two webs A and A', which have been hot-pressed to dissimilar degrees of compression.

4. A process for manufacturing a multi-layer ink ribbon including a step of superposing a plurality of woven webs, each constructed by using multifilament yarns for both warp and weft, to form an assembly and fuse-cutting the assembly to a width of a ribbon, comprising:

compressing at least one of said webs by hot pressing to form a compressed web having a thickness of about 15–50% of a thickness prior to pressing, assembling the compressed web with at least another one of said webs which has been either not hot-pressed or hot-pressed to a degree of compression different from that of said compressed web to form an assembly, fuse-cutting the assembly under pressure to provide a multi-layer ribbon and inking the multi-layer ribbon.

* * * * *